US010724389B2

(12) United States Patent
Barainca et al.

(10) Patent No.: US 10,724,389 B2
(45) Date of Patent: Jul. 28, 2020

(54) STATOR VANE ASSEMBLY FOR A GAS TURBINE ENGINE

(71) Applicant: UNITED TECHNOLOGIES CORPORATION, Farmington, CT (US)

(72) Inventors: Brian Barainca, Kennebunk, ME (US); Paul W. Baumann, Amesbury, MA (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 461 days.

(21) Appl. No.: 15/645,881

(22) Filed: Jul. 10, 2017

(65) Prior Publication Data

US 2019/0010816 A1 Jan. 10, 2019

(51) Int. Cl.

| | |
|---|---|
| ***F01D 9/04*** | (2006.01) |
| ***F04D 29/64*** | (2006.01) |
| ***F04D 29/54*** | (2006.01) |

(52) U.S. Cl.

CPC ..... *F01D 9/042* (2013.01); *F01D 9/041* (2013.01); *F04D 29/542* (2013.01); *F04D 29/644* (2013.01); *F05D 2220/32* (2013.01); *F05D 2230/60* (2013.01); *F05D 2230/644* (2013.01); *F05D 2240/125* (2013.01); *F05D 2260/36* (2013.01)

(58) Field of Classification Search

CPC ..... F01D 9/042; F01D 9/041; F04D 29/542; F04D 29/644; F05D 2260/36; F05D 2230/60; F05D 2230/644; F05D 2240/125; F05D 2220/32

See application file for complete search history.

(56) References Cited

U.S. PATENT DOCUMENTS

| | | | | |
|---|---|---|---|---|
| 2,812,159 A * | 11/1957 | Krebs | F01D 9/042 415/119 |
| 4,452,564 A | 6/1984 | Conant et al. | |
| 6,409,472 B1 * | 6/2002 | McMahon | F01D 5/3023 415/119 |
| 6,655,912 B2 * | 12/2003 | Bos | F01D 9/042 415/209.4 |

(Continued)

FOREIGN PATENT DOCUMENTS

| | | |
|---|---|---|
| EP | 1079075 | 2/2001 |
| EP | 2072760 | 6/2009 |

(Continued)

OTHER PUBLICATIONS

European Patent Office, European Search Report dated Nov. 22, 2018 in Application No. 18179562.6.

(Continued)

*Primary Examiner* — Xiao En Mo

(74) *Attorney, Agent, or Firm* — Snell & Wilmer, L.L.P.

(57) ABSTRACT

A gas turbine engine has a stator vane assembly. The stator vane assembly includes an inner diameter shroud, an outer diameter shroud located radially outward from the inner diameter shroud, a vane extending radially outward from the first inner diameter shroud to the outer diameter shroud. The wedge clip is positioned horizontally through the vane to prevent the vane from being dislodged from the stator vane assembly.

15 Claims, 5 Drawing Sheets

(56) References Cited

U.S. PATENT DOCUMENTS

| | | | | |
|---|---|---|---|---|
| 8,910,947 | B2 | 12/2014 | Voisine et al. | |
| 9,322,286 | B2 * | 4/2016 | Digard Brou De Cuissart | F01D 9/041 |
| 9,644,640 | B2 * | 5/2017 | Kabala | F01D 9/041 |
| 10,190,426 | B2 * | 1/2019 | Fremont | F01D 9/042 |
| 2016/0003075 | A1 * | 1/2016 | Feigleson | F01D 9/042 415/191 |
| 2017/0074110 | A1 | 3/2017 | Fremont | |

FOREIGN PATENT DOCUMENTS

| | | |
|---|---|---|
| EP | 2204539 | 7/2010 |
| GB | 2272027 | 5/1994 |
| WO | 2015132523 | 9/2015 |

OTHER PUBLICATIONS

European Patent Office, European Office Action dated Dec. 3, 2019 in Application No. 18179562.6.

* cited by examiner

STATOR VANE ASSEMBLY FOR A GAS TURBINE ENGINE

FIELD

The present disclosure is directed to a gas turbine engine. More particularly, to a stator vane assembly and a method of installing a stator vane in a gas turbine engine.

BACKGROUND

Gas turbine engines include a compressor section, a turbine section, and a combustor section. Many gas turbine engines also include a fan that is driven by the turbine section. The fan generates a core airflow that is received by the compressor section and a bypass airflow that bypasses the compressor, turbine, and combustor sections and generates thrust. Stator vanes may be located upstream from the compressor and may condition the core airflow. It is undesirable for the stator vanes to become dislodged in response to ingestion of an object, such as a bird, in the core airflow.

SUMMARY

In various embodiments, a gas turbine engine having a stator vane assembly includes an inner diameter shroud, an outer diameter shroud located radially outward from the inner diameter shroud, and a vane extending radially outward from the first inner diameter shroud to the outer diameter shroud. A wedge clip is positioned horizontally through the vane to prevent the vane from being dislodged from the stator vane assembly. In various embodiments, the vane of gas turbine engine has a first end and a first slot located at the first end, the first slot being used to position the wedge clip.

The wedge clip of the gas turbine engine has a wedge portion that prevents the wedge portion from dislodging from the stator vane assembly. In various embodiments, the outer diameter shroud of the gas turbine engine is a single unit outer diameter shroud. The wedge clip of the gas turbine engine has a wedge portion with a first end having a first thickness and a bendable edge having a second thickness, wherein the first thickness is greater than the second thickness. The wedge portion of the wedge clip of the gas turbine engine springs to an initial position after being placed through a first slot at a first end of the vane. In various embodiments, a width of a wedge portion of the wedge clip and an angle of elevation of a first side of the wedge portion prevents the wedge clip and the vane from being dislodged. In various embodiments, a bendable edge of the wedge clip of the gas turbine engine allows the wedge clip to prevent the vane from dislodging from the outer diameter shroud.

In various embodiments of the gas turbine engine, a u-shape coupling of a wedge portion of the wedge clip to a non-wedge portion of the wedge clip allows the wedge portion to be a bendable wedge portion. In various embodiments of the gas turbine engine, a cornered and a quasi-corned design of the wedge clip self-centers the wedge clip to prevent a toggling of the wedge clip in a horizontal or a vertical direction.

In various embodiments, a method of assembling a stator vane assembly includes angling a vane into a first slot of an outer diameter shroud, aligning the vane into a first slot of an inner diameter shroud, and placing a wedge clip into a first slot of the vane to prevent the vane from dislodging from the stator vane assembly. In various embodiments, the method further includes bending a wedge portion of the wedge clip flush with the wedge clip when placing the wedge clip into the first slot of the vane. In various embodiments, the method further includes self-centering the wedge clip into the first slot of the vane when placing the wedge clip into the first slot of the vane. In various embodiments, the method further includes using a wedge portion of the wedge clip to act as a mechanical retention mechanism of the wedge clip to the stator vane assembly.

In various embodiments, a stator vane assembly includes an inner diameter shroud, an outer diameter shroud located radially outward from the inner diameter shroud, and a vane extending radially outward from the first inner diameter shroud to the outer diameter shroud, wherein a wedge clip is positioned horizontally through the vane to prevent the vane from being dislodged from the stator vane assembly. In various embodiments of the stator vane assembly, the vane has a first end and a first slot located at the first end, the first slot being used to position the wedge clip. In various embodiments of the stator vane assembly, the wedge clip has a wedge portion that prevents the wedge clip from dislodging from the stator vane assembly. In various embodiments of the stator vane assembly, the outer diameter shroud is a single unit outer diameter shroud.

In various embodiments of the stator vane assembly, a u-shape coupling of a wedge portion of the wedge clip to a non-wedge portion of the wedge clip allows the wedge portion to be a bendable wedge portion.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed, non-limiting, embodiments. The drawings that accompany the detailed description can be briefly described as follows.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

As used herein, "aft" refers to the direction associated with the exhaust (e.g., the back end) of a gas turbine engine. As used herein, "forward" refers to the direction associated with the intake (e.g., the front end) of a gas turbine engine. An A-R-C axis is shown in various drawings to illustrate the axial, radial, and circumferential directions, respectively.

As used herein, "radially outward" refers to the direction generally away from the axis of rotation of a turbine engine. As used herein, "radially inward" refers to the direction generally towards the axis of rotation of a turbine engine.

Figure 1:
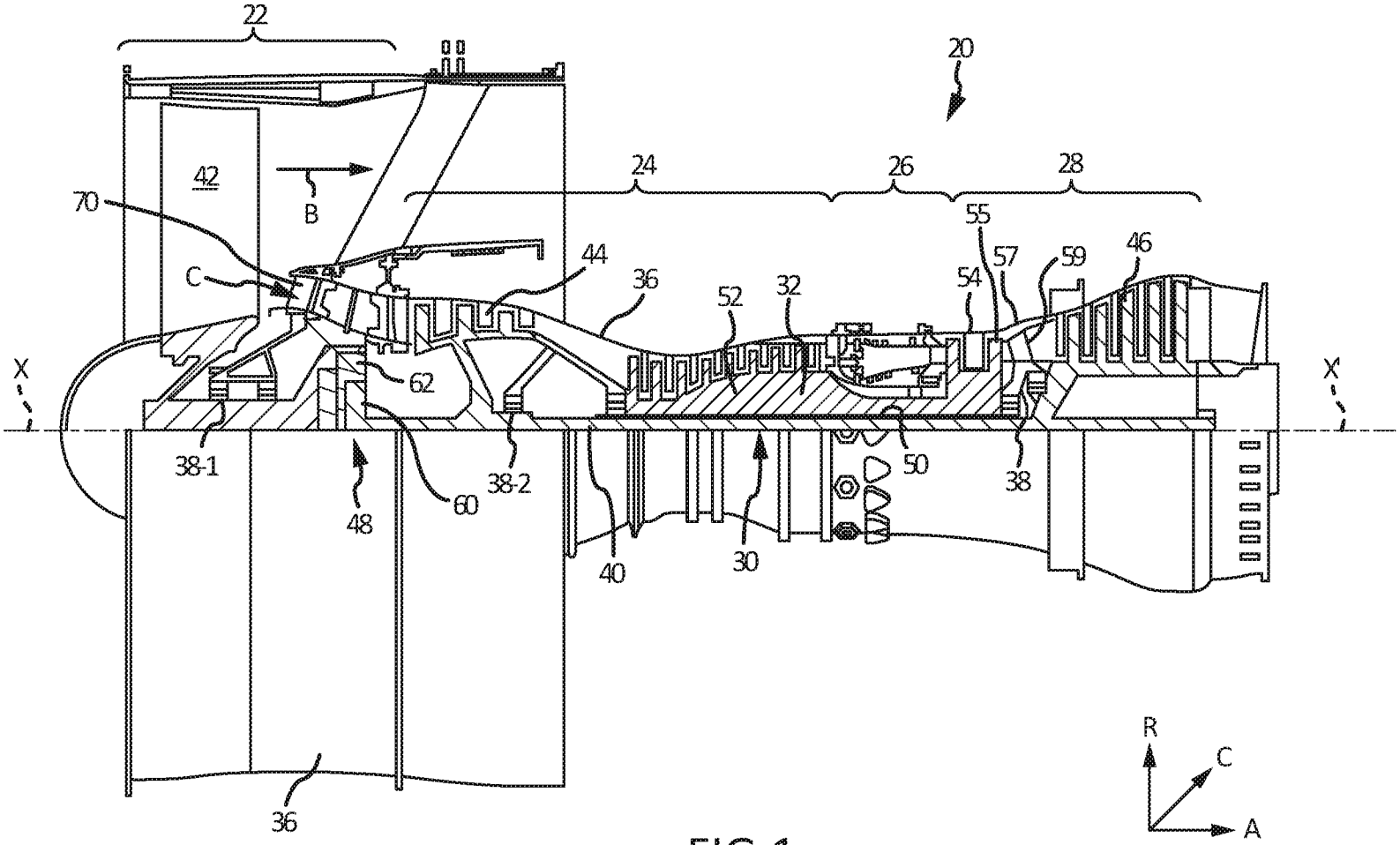
FIG. 1 is a cross-sectional view of an exemplary gas turbine engine, in accordance with various embodiments.

In various embodiments and with reference to FIG. 1, a gas turbine engine 20 is provided. The gas turbine engine 20 may be a two-spool turbofan that generally incorporates a fan section 22, a compressor section 24, a combustor section 26 and a turbine section 28. Alternative engines may include, for example, an augmentor section among other systems or features. In operation, the fan section 22 can drive coolant (e.g., air) along a bypass flow path B while the compressor section 24 can drive coolant along a core flow path C for compression and communication into the combustor section 26 then expansion through the turbine section 28. Although depicted as a two-spool turbofan gas turbine engine 20 herein, it should be understood that the concepts described herein are not limited to use with two-spool turbofans as the teachings may be applied to other types of turbine engines including turbojet, turboprop, turboshaft, or power generation turbines, with or without geared fan, geared compressor or three-spool architectures.

The gas turbine engine 20 may generally comprise a low speed spool 30 and a high speed spool 32 mounted for rotation about an engine central longitudinal axis X-X' relative to an engine static structure 36 or engine case via several bearing systems 38, 38-1, and 38-2. It should be understood that various bearing systems 38 at various locations may alternatively or additionally be provided, including for example, the bearing system 38, the bearing system 38-1, and the bearing system 38-2.

The low speed spool 30 may generally comprise an inner shaft 40 that interconnects a fan 42, a low pressure compressor 44 and a low pressure turbine 46. The inner shaft 40 may be connected to the fan 42 through a geared architecture 48 that can drive the fan 42 at a lower speed than the low speed spool 30. The geared architecture 48 may comprise a gear assembly 60 enclosed within a gear housing 62. The gear assembly 60 couples the inner shaft 40 to a rotating fan structure. The high speed spool 32 may comprise an outer shaft 50 that interconnects a high pressure compressor 52 and high pressure turbine 54. A combustor 26 may be located between high pressure compressor 52 and high pressure turbine 54. A mid-turbine frame 57 of the engine static structure 36 may be located generally between the high pressure turbine 54 and the low pressure turbine 46. Mid-turbine frame 57 may support one or more bearing systems 38 in the turbine section 28. The inner shaft 40 and the outer shaft 50 may be concentric and rotate via bearing systems 38 about the engine central longitudinal axis X-X', which is collinear with their longitudinal axes. As used herein, a "high pressure" compressor or turbine experiences a higher pressure than a corresponding "low pressure" compressor or turbine.

Figure 2:
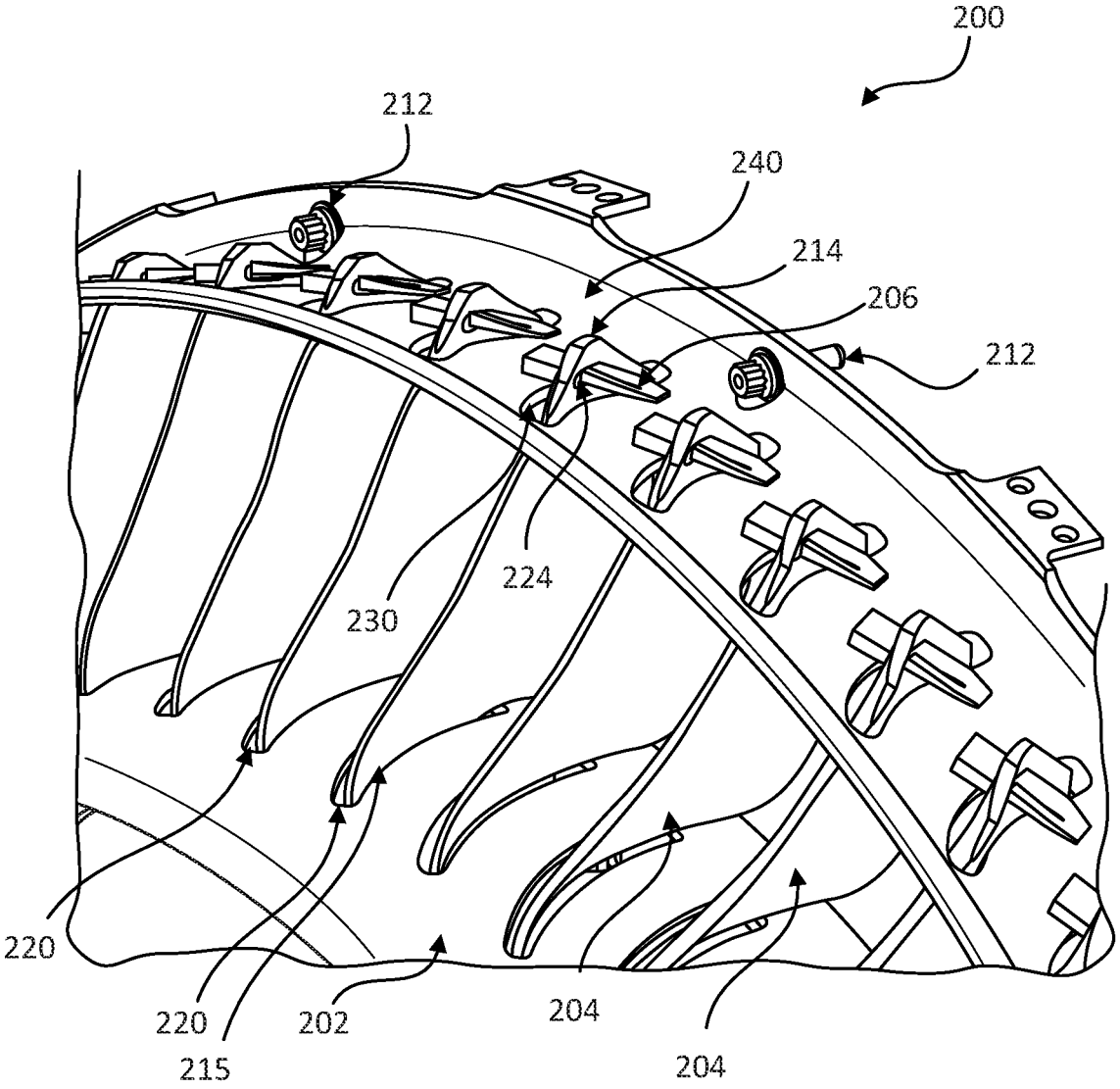
FIG. 2 is a perspective view of a portion of a stator vane assembly, in accordance with various embodiments.

In various embodiments, gas turbine 20 may include, for example, stator vane assembly 200 depicted in FIG. 2. Stator vane assembly 200 may include, for example, an outer diameter shroud 240, an inner diameter shroud 202, vanes 204, bolts 212, and wedge clips 206. Outer diameter shroud 240 may include a plurality of outer diameter slots 230. Inner diameter shroud 202 may include a plurality of inner diameter slots 220. In various embodiments, inner diameter shroud 202 and outer diameter shroud 210 may be radially spaced apart such that vanes 204 may be arranged circumferentially about the X axis depicted in FIG. 1. Vanes 204 may be arranged to support stator vane assembly 200 and may be positioned to extend from inner diameter shroud 202 to outer diameter shroud 240.

In various embodiments, vane 204 may have a first end 214 and a second end 215. First end 214 may have a slot 224 associated with first end 214. Second end 215 may have a slot 226 (shown in FIG. 5) associated with second end 215. First end 214 of vane 204 extends through outer diameter shroud 240 via outer diameter slot 230, thereby allowing wedge clip 206 to be inserted into slot 224 to hold vane 204 firmly into place. The insertion of wedge clip 206 into slot 224 may tend to prevent vane 204 from being dislodged from stator vane assembly 200.

In various embodiments, outer diameter shroud 240 may be located radially outward from a plurality of vanes 204 and may retain the plurality of vanes 204 in place relative to stator vane assembly 200. Outer diameter shroud 240 may be coupled to, for example, a front center body (FCB) with bolts 212. In various embodiments, bolts 212 may be used to bolt outer diameter shroud to the FCB for bird strike resistance. In various embodiments, the addition of a single piece outer diameter shroud 240 allows for vanes 204 to remain secure, preventing vanes 204 from undesirably becoming dislodged in response to sufficient radially outward deflection of the outer diameter shroud 240. In various embodiments, it may desirable to reduce radially outward deflection of outer diameter shroud 240.

Figure 3:
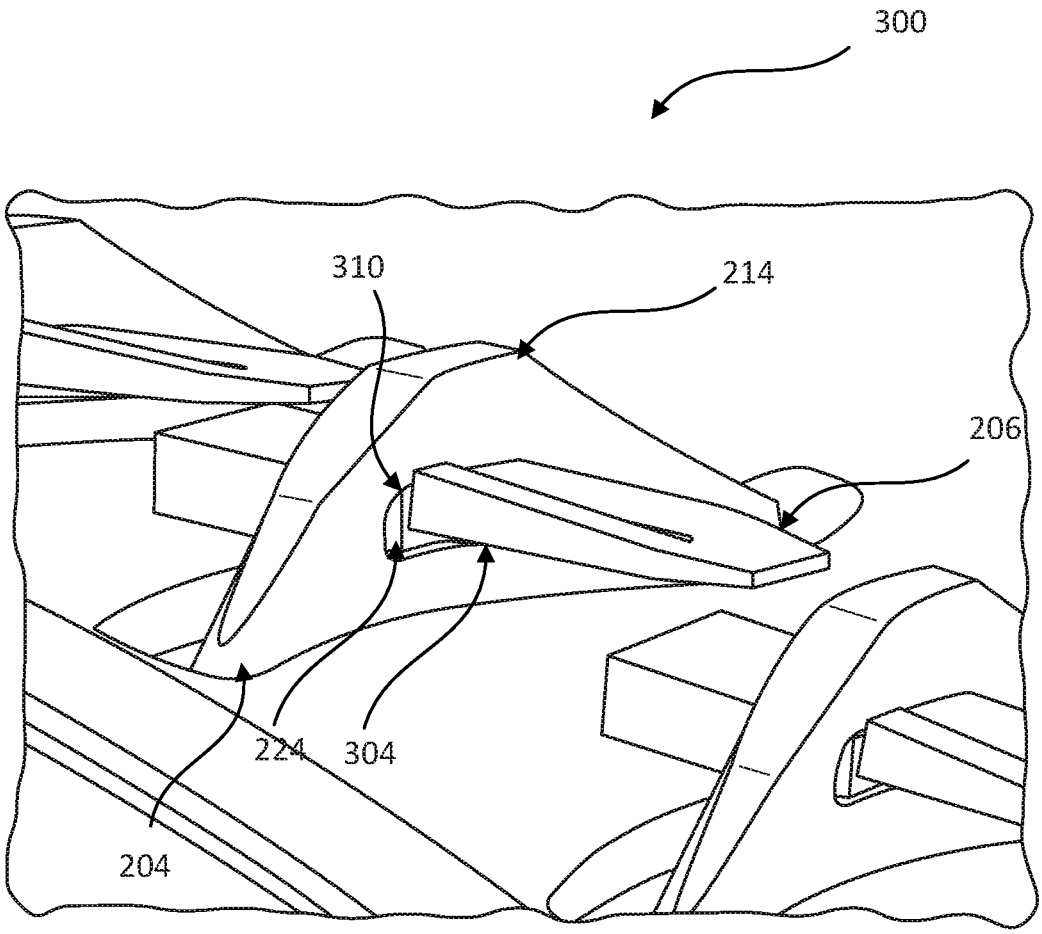
FIG. 3 is a perspective view of a portion of a stator vane assembly, in accordance with various embodiments.

FIG. 3 depicts a perspective view of a portion 300 of stator vane assembly 200 according to various embodiments. In various embodiments, FIG. 3 shows a structural example of wedge clip 206 preventing vane 204 from being dislodged from stator assembly 200. Vane 204 includes first end 214, slot 224, and a slot edge 310. Wedge clip 206 includes a wedge portion 304 (e.g., a tine, locking arm, or locking tab) cut from the side of wedge clip 206. In various embodiments, wedge clip 206 may be inserted horizontally into slot 224 to allow vane 204 to remain securely fastened to outer diameter shroud 240. Wedge portion 304 extends radially such that wedge clip 206 is able to prevent wedge clip 206 from being dislodged. In various embodiments, wedge portion 304 may be bent radially to prevent wedge clip 206 from backing out slot 224. Wedge portion 304 may, for example, bend and/or displace vertically during installation and spring back into place once wedge portion 304 extends through slot 224. In various embodiments, wedge portion 304 may be designed such that the thickness of wedge portion 304 combined with the angle of elevation of wedge portion 304 prevents wedge clip 206 from being dislodged. In various embodiments, the wedge shape of wedge clip 206 may prevent the wedge portion 304 from pushing through slot 224 and hold wedge clip 206 in place to prevent circumferential migration due to vibration.

Figure 4:
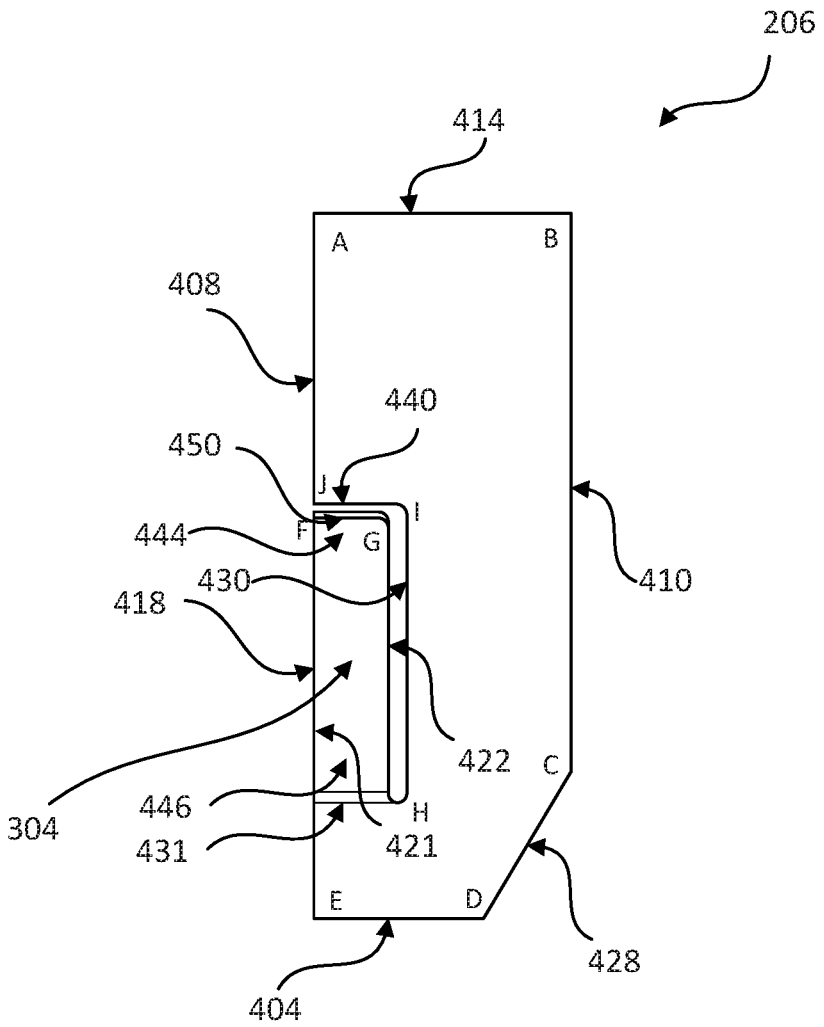
FIG. 4 is a top view perspective of the wedge clip of the stator vane assembly of FIG. 3, in accordance with various embodiments.

FIG. 4 illustrates a top view perspective of wedge clip 206 of stator vane assembly 200 according to various embodiments. Wedge clip 206 includes a first side portion 408, a first side portion 418, a second side portion 410, a third side portion 428, a fourth side portion 414, a fifth side portion 404, a sixth side portion 440, a seventh side portion 430, a second side 422, and a first side 450. Wedge portion 304 of wedge clip 206 includes a first end 444, a second end 446, first side 450, second side 422, a third side 421, and a bendable edge 431.

In various embodiments, first side portion 408 is coupled to fourth side portion 414 at point A. Fourth side portion 414 is coupled to second side portion 410 point B. Second side portion 410 is coupled to third side portion 428 point C. Third side portion 428 is coupled to fifth side portion 404 at point D. Fifth side portion 404 is coupled to first side portion 418 at point E. First side portion 418 is coupled to first side 450 at point F. First side 450 is coupled to second side 422 at point G. Second side 422 is coupled to seventh side 430 at point H. Seventh side 430 is coupled to sixth side portion 440 at point I. Sixth side portion 440 is coupled to first side portion 408 at point J. In various embodiments, points A, B, E, F, G, I, and J are cornered points whose coupled sides corner to approximately 90 degrees. Points C and D are quasi-corned points whose coupled sides have angles equating to greater than 90 degrees. In various embodiments, point H has incoming sides that form a U-shape at point H. In various embodiments, wedge portion 304 is bendable or flexible at bendable edge 431. In various embodiments, wedge portion 304 has a thickness at first end 444 of wedge portion 304 that increases in the direction of slot 224 toward vane 204. In various embodiments, the thickness of is greater than the thickness at a second end 446 of wedge portion 304.

Figure 5:
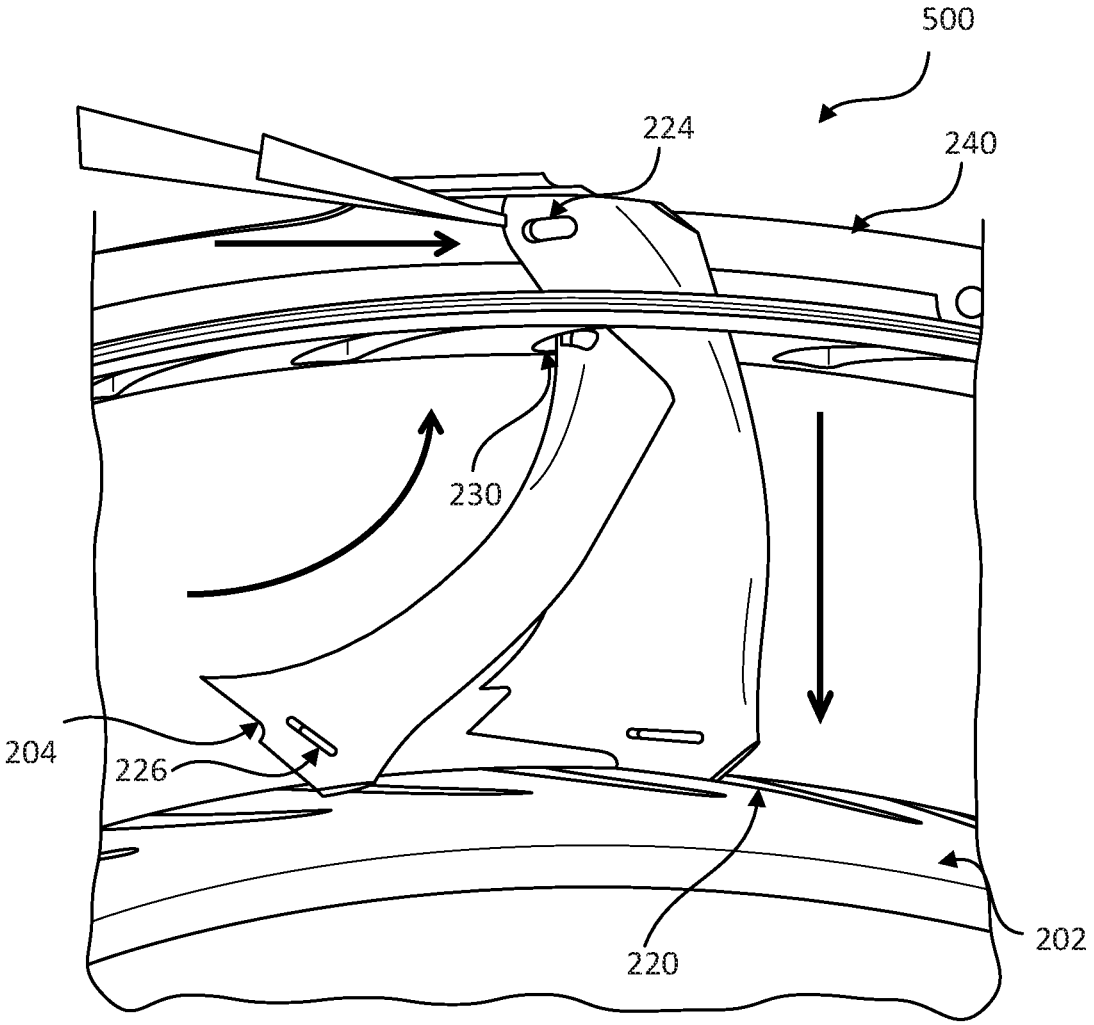
FIG. 5 is an illustration of methods of installing a vane and wedge clip into a stator vane assembly of a gas turbine engine, in accordance with various embodiments.

FIG. 5 illustrates a method 500 of installing vane 204 into stator vane assembly 200 according to various embodiments. In various embodiments, vane 204 is angled or rocked into outer diameter shroud 240. Vane 204 is pushed or placed into inner diameter shroud 202. Wedge clip 206 (depicted in FIG. 2) is placed into slot 224. In various embodiments, wedge portion 304 (depicted in FIG. 3) of wedge clip 206 bends flush as wedge clip 206 is pushed through slot 224. Wedge portion 304 may bend radially relative to the engine central longitudinal axis X-X' so that wedge clip 206 clips in place to vane 204, thereby minimizing the dislodging of vane 204 from stator vane assembly 200. In various embodiments, wedge portion 304 may spring back into its initial position once wedge portion 304 passes through slot 224. In various embodiments, wedge portion 304 acts as a mechanical retention mechanism. In various embodiments, the shape of wedge clip 206 centers wedge clip 206 (i.e., allows wedge clip 206 to self-center itself in slot 224) with respect to vane 204 thereby preventing the toggling of wedge clip 206 radially, axially, and/or circumferentially relative to the engine central longitudinal axis X-X'.

In various embodiments, the outer diameter shroud 240 may be a single piece. As described, it is desirable for the outer diameter shroud 240 to resist movement in the radially outward direction which may occur, for example, during a bird strike (i.e., when a bird is ingested into gas turbine engine 20).

While the disclosure is described with reference to exemplary embodiments, it will be understood by those skilled in the art that various changes may be made and equivalents may be substituted without departing from the spirit and scope of the disclosure. In addition, different modifications may be made to adapt the teachings of the disclosure to particular situations or materials, without departing from the essential scope thereof. The disclosure is thus not limited to the particular examples disclosed herein, but includes all embodiments falling within the scope of the appended claims.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of a, b, or c" is used in the claims, it is intended that the phrase be interpreted to mean that a alone may be present in an embodiment, b alone may be present in an embodiment, c alone may be present in an embodiment, or that any combination of the elements a, b and c may be present in a single embodiment; for example, a and b, a and c, b and c, or a and b and c. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A gas turbine engine having a stator vane assembly comprising:

an inner diameter shroud;

an outer diameter shroud located radially outward from said inner diameter shroud; and a vane extending radially from said inner diameter shroud to said outer diameter shroud, wherein said vane defines a first slot located at least one of radially outward of said outer diameter shroud or radially inward of said inner diameter shroud; and a wedge clip positioned axially through said first slot of said vane, wherein said wedge clip has a wedge portion, said wedge portion including a first end and a bendable edge opposite said first end, wherein said bendable edge is configured to cause said wedge portion to spring from a flush position to an initial position after said bendable edge and said first end of said wedge portion pass through said first slot of said vane.

2. The gas turbine engine of claim 1, wherein said wedge portion prevents said wedge clip from dislodging from said stator vane assembly.

3. The gas turbine engine of claim 1, wherein said outer diameter shroud is a unitary continuous material.

4. The gas turbine engine of claim 1, wherein said first end of said wedge portion of said wedge clip has a first thickness and said bendable edge of said wedge portion has a second thickness, wherein said first thickness is greater than said second thickness.

5. The gas turbine engine of claim 1, wherein a width of said wedge portion of said wedge clip and an angle of elevation of a first side of said wedge portion prevents said wedge clip and said vane from being dislodged, said first side extending from said first end to said bendable edge of said wedge clip.

6. The gas turbine engine of claim 1, wherein a u-shape coupling of said wedge portion of said wedge clip to a non-wedge portion of said wedge clip allows said wedge portion to be bendable at said bendable edge of said wedge portion.

7. The gas turbine engine of claim 1, wherein said wedge clip comprises a plurality of cornered points and a plurality of quasi-corned points, wherein each of said cornered points has coupled sides cornered at 90°, and wherein each of said quasi-cornered points has coupled side cornered at an angle greater than 90°, and wherein said cornered points and said quasi-cornered points prevent a toggling of said wedge clip radially, axially, and/or circumferentially relative to an engine central longitudinal axis X-X'.

8. A method of assembling a stator vane assembly comprising:

angling a vane into a first slot of an outer diameter shroud;

aligning said vane into a first slot of an inner diameter shroud; and placing a wedge clip into a first slot of said vane, the first slot of said vane being located at least one of radially outward from said outer diameter shroud or radially inward from said inner diameter shroud, wherein said wedge clip has a wedge portion, the wedge portion including a first end and a bendable edge opposite the first end, wherein said bendable edge is configured to cause said wedge portion to spring from a flush position to an initial position after said bendable edge and said first end of said wedge portion pass through said first slot of said vane.

9. The method of claim 8 further comprising extending said vane from said inner diameter shroud to said outer diameter shroud.

10. The method of claim 8 further comprising self-centering said wedge clip into said first slot of said vane when placing said wedge clip into said first slot of said vane.

11. The method of claim 8, wherein said wedge portion of said wedge clip is configured to act as a mechanical retention mechanism for securing said vane to at least one of said outer diameter shroud or said inner diameter shroud.

12. A stator vane assembly comprising:

an inner diameter shroud;

an outer diameter shroud located radially outward from said inner diameter shroud; and a vane extending radially outward from said inner diameter shroud to said outer diameter shroud, wherein said vane defines a first slot located at least one of radially outward of said outer diameter shroud or radially inward of said inner diameter shroud; and a wedge clip positioned axially through said first slot of said vane, wherein said wedge clip has a wedge portion, said wedge portion including a first end and a bendable edge opposite said first end, wherein said bendable edge is configured to cause said wedge portion to spring from a flush position to an initial position after said bendable edge and said first end of said wedge portion pass through said first slot of said vane.

13. The stator vane assembly of claim 12, wherein said wedge portion prevents said wedge clip from dislodging from said stator vane assembly.

14. The stator vane assembly of claim 12, wherein said outer diameter shroud is a single unit outer diameter shroud.

15. The stator vane assembly of claim 12, wherein a u-shape coupling of said wedge portion of said wedge clip to a non-wedge portion of said wedge clip allows said wedge portion to be bendable at said bendable edge of said wedge portion.

* * * * *